US005445686A

United States Patent [19]

Ueshima et al.

[11] Patent Number: 5,445,686

[45] Date of Patent: Aug. 29, 1995

[54] FE-CU ALLOY SHEET HAVING AN ALLOY STRUCTURE OF HIGH UNIFORMITY

[75] Inventors: Yoshiyuki Ueshima; Toshiaki Mizoguchi; Kenichi Miyazawa, all of Kimitsu; Satoshi Nishimura, Sagamihara, all of Japan

[73] Assignee: Nippon Steel Corporation, Japan

[21] Appl. No.: 252,424

[22] Filed: Jun. 1, 1994

Related U.S. Application Data

[63] Continuation-in-part of Ser. No. 778,074, filed as PCT/JP91/00463, Apr. 8, 1991, abandoned.

[30] Foreign Application Priority Data

Apr. 9, 1990 [JP] Japan ..... 2-93440

[51] Int. Cl.[6] ..... C22C 9/00; C22C 38/20

[52] U.S. Cl. ..... 148/330; 148/332; 148/411; 420/61; 420/90; 420/495; 420/582

[58] Field of Search ..... 420/60, 61, 90, 495, 420/496, 582; 148/330, 332, 411

[56] References Cited

U.S. PATENT DOCUMENTS 4,869,758 9/1989 Watanabe et al. ..... 420/90

FOREIGN PATENT DOCUMENTS 48-00129 1/1973 Japan ..... 420/90
49-91025 8/1974 Japan .
60-152640 8/1985 Japan .
62-70541 4/1987 Japan .
63-149344 6/1988 Japan .
63-293147 11/1988 Japan .
1-073034 3/1989 Japan .

*Primary Examiner*—George Wyszomierski
*Attorney, Agent, or Firm*—Pollock, Vande Sande & Priddy

[57] ABSTRACT

An Fe-Cu alloy sheet manufactured by a thin plate continuous casting method so as to be used as a material of electronic and magnetic parts. The alloy sheet has an alloy structure of high uniformity which contains 20 to 90% Cu, 1 to 10% Cr, 0 to 10% Mo, and one or more of alloying elements selected from the group consisting of Al, Sc, Y, La, Si, Ti, Zr and Hf whose amount or total amounts are not less than a calcualtion value of the following equation and not more than 10%, the balance being essentially Fe:

$$\alpha\left(\frac{(\%\ Cr)+2(\%\ Mo)-3}{3}-\beta\frac{|(\%\ Cu)-50|}{300}\right)$$

wherein $\alpha=1$, $\beta=51-(\%Cu)$ (in the case where Cu=20 to 50%), $\beta=-19+0.4\ (\%\ Cu)$ (in the case where Cu=50 to 90%).

Boron and/or carbon take substantially the same effects as the above-mentioned elements such as Al.

3 Claims, 3 Drawing Sheets

FE-CU ALLOY SHEET HAVING AN ALLOY STRUCTURE OF HIGH UNIFORMITY

This application is a continuation-in-part, of Ser. No. 07/778,074 filed as PCT/JP91/00463, Apr. 8, 1991, now abandoned.

TECHNICAL FIELD

The present invention relates to an Fe—Cu alloy sheet having an alloy structure of high uniformity which is used as a material of electronic and magnetic parts or the like.

BACKGROUND ART

Conventionally, Kovar (Fe-29Ni-16Co), 42 Alloy (Fe-42% Ni), stainless steel disclosed in JP-A-63-293143 and so on have been used as a material of electronic and magnetic parts in semiconductor equipment or the like. However, those alloys have a problem that they are expensive, and they also have a problem that they are inferior in conductivity and heat-radiation efficiency. In order to improve these characteristics, therefore, a copper (Cu) base alloy has come into use recently.

The Cu-base alloy of which copper content is 90% or more is low in the strength. Consequently, it is effective to add iron to the Cu-base alloy as a strengthening element, and to add chromium to it, as disclosed in JP-A-49-91025 (an alloy for sliding contact parts of electric equipments) or the like, so as to improve the corrosion resistance property as well. Moreover, as disclosed in Iron and Steel Handbook, the third edition, Vol. IV, pp. 211–212 (compiled by Japan Iron and Steel Association), adding molybdenum to improve the corrosion resistance property is a known method. The problem is, however, that additions of such alloying elements deteriorate uniformity of the alloy.

It should be noted that the Fe—Cu—Cr alloy which is disclosed in JP-A-49-91025 is not intended as a material of electronic and magnetic parts. Although the stainless steel for an electronic material which is disclosed in JP-A-63-293143 is intended for the same kind of use, it has obviously different elements in the compositions. Further, an alloy strip manufacturing method disclosed in JP-A-60-152640 is obscure in the kind of composition, restriction of additive elements, and effective concentration ratios. Furthermore, none of these preceding techniques discloses any suggestion concerning the manufacture of an Fe—Cu alloy having high uniformity which is the object of the present invention, so that it is doubtful whether such an alloy can be manufactured or not.

Among Fe—Cu alloys, for example, an alloy containing 50% copper exhibits a uniform liquid phase unless it contains chromium. However, if it contains 3% or more chromium, when it is melted, it becomes a molten liquid which is divided into a liquid phase rich in iron and another liquid phase rich in copper. If such an alloy having two divided phases, i.e., the liquid phases rich in iron and copper respectively, is cast, a uniform product can not be obtained. That is to say, grains in the iron-rich liquid phase and grains in the copper-rich liquid phase increase in size during the melting operation, and after they solidify, there are generated crackings in interfaces between those two phases during cold working, causing disadvantages such as poor bending characteristics of final products.

DISCLOSURE OF THE INVENTION

Thus, it is an object of the present invention to produce an alloy sheet having a fine and uniform structure according to a thin plate continuous casting method by adding particular elements to an Fe—Cu—Cr alloy or an Fe—Cu—Cr—Mo alloy so as to solve the problem or non-uniformity of the alloy structure due to the above-described phenomenon that grains in the liquid phase rich in iron and grains in the liquid phase rich in copper increase in size during the melting operation.

With respect to the object, there are provided alloy sheets as follows.

(1) An Fe—Cu alloy sheet manufactured by a thin plate continuous casting method, the alloy sheet having an alloy structure of high uniformity which contains, by weight, 20 to 90% Cu, 1 to 10% Cr, 0 to 10% Mo, and one or more of alloying elements selected from the group consisting of Al, Sc, Y, La, Si, Ti, Zr and Hf whose amount or total amounts expressed as % X are not less than a calculation value of the following equation and not more than 10%, the balance being essentially Fe:

$$\% X_o = \alpha\left(\frac{(\%\ \mathrm{Cr}) + 2(\%\ \mathrm{Mo}) - 3}{3} - \beta\frac{|(\%\ \mathrm{Cu}) - 50|}{300}\right)$$

wherein $\alpha=1$, and wherein when the calculation value % $X_o$ of the equation is less than 0.01, % X is considered to be about 0.01

$\beta=51-(\%\ \mathrm{Cu})$ (in the case where Cu=20 to 50%), $\beta=-19+0.4\ (\%\ \mathrm{Cu})$ (in the case where Cu=50 to 90%), and wherein when the calculation value % $X_o$ of the equation is less than 0.0001 then % X is considered to be about 0.0001 and further, $|(\%\ \mathrm{Cu})-50|$ is an absolute value of "% Cu−50".

(2) An Fe—Cu alloy sheet manufactured by a thin plate continuous casting method, the alloy sheet having an alloy structure of high uniformity which contains, by weight, 20 to 90% Cu, 1 to 10% Cr, 0 to 10% Mo, and boron (B) and/or carbon (C) whose amount or total amounts have a lower limit value expressed as % X which is a calculation value of the following equation, and have an upper limit value which is 1% when only boron is added and when boron and carbon are added and which is 3% when only carbon is added, the balance being essentially Fe:

$$\% X_o = \alpha\left(\frac{(\%\ \mathrm{Cr}) + 2(\%\ \mathrm{Mo}) - 3}{3} - \beta\frac{|(\%\ \mathrm{Cu}) - 50|}{300}\right)$$

wherein $\alpha=0.01$, $\beta=51-(\%\ \mathrm{Cu})$ (in the case where Cu=20 to 50%), $\beta=19+0.4\ (\%\ \mathrm{Cu})$ (in the case where Cu=50 to 90%) and wherein when the calculation value % $X_o$ of the equation is less than 0.0001 then % X is considered to be about 0.0001.

(3) An Fe—Cu alloy sheet manufactured by a thin plate continuous casting method, the alloy sheet having an alloy structure of high uniformity which contains, by weight:

20 to 90% Cu;

1 to 10% Cr;

0 to 10% Mo;

one or more of alloying elements selected from the group consisting of Al, Sc, Y, La, Si, Ti, Zr and Hf whose amount or total amounts expressed as % X are not less than a calculation value of the following equation and not more than 10%; and boron and/or carbon whose amount or total amounts have a lower limit value expressed as % X which is a calculation value of the following equation, and have an upper limit value which is 1% when only boron is added and when both boron and carbon are added and which is 3% when only carbon is added, the balance being essentially Fe.

Equation:

$$\% X_o = \alpha\left(\frac{(\% \text{ Cr}) + 2(\% \text{ Mo}) - 3}{3} - \beta\frac{|(\% \text{ Cu}) - 50|}{300}\right)$$

wherein $\alpha=1$ (in the case where the amounts of elements belonging to the group comprising Al, Sc, y, La, Si, TiZr, or Hf are calculated) and wherein when the calculation value % $X_o$ of the equation is less than 0.01, % X is considered to be about 0.01, $\alpha=0.01$ (in the case where the amounts of B and C are calculated) and wherein when the calculation value % $X_o$ of the equation is less than 0.0001 then % X is considered to be about 0.0001, $\beta=51-(\%\text{ Cu})$ (in the case where Cu=20 to 50%), $\beta=-19+0.4$ (% Cu) (in the case where Cu=50 to 90%).

The alloy plate according to the present invention is used as a material of electronic and magnetic parts, and made of the alloy whose basic alloy components are iron and copper, the alloy containing copper in a range of 20% to 90%. The alloy requires at least 20% or more copper to be contained in order to enhance the electric conductivity. Iron is also added to the alloy for improving the strength of the alloy. The range of iron content varies in accordance with purposes, and it is balanced with the electric conductivity and the strength and determined in relation with other additive elements. However, if iron is added excessively, the corrosion resistance property may be deteriorated. Chromium is added in a range of 1 to 10% so as to improve the corrosion resistance, property. However, since chromium increases repulsive forces between the atoms which are the alloy components in the molten metal, there is induced division into two phases, i.e., the liquid phase rich in iron and the liquid phase rich in copper. Although molybdenum is added as occasion demands, it may cause the same kind of phenomenon as in the case of chromium. As described previously, if the molten metal having two divided phases is cast as it is, coarse crystalline grains of the phase rich in iron and the phase rich in copper will exist in castings. Therefore, it is difficult to work such metal into a material of electronic equipments and the like, and there are induced disadvantages in relation to characteristics of final products.

In the present invention, one or more alloying elements selected from the group consisting of Al, Sc, Y (yttrium), La, Si, Ti, Zr and Hf are further added to the above-mentioned basic components, and this addition takes an effect of suppressing the division into two coarse phases of the above-described base alloy. In other words, when these alloying elements are added to the molten metal, attraction forces between the elements is enhanced when they are melted so that the liquid phase will not be divided into two phases. Therefore, it is necessary to add one or more alloying elements selected from the group described above, the amounts of which expressed as % X are not less than a calculation value of the following equation:

$$\% X_o = \alpha\left(\frac{(\% \text{ Cr}) + 2(\% \text{ Mo}) - 3}{3} - \beta\frac{|(\% \text{ Cu}) - 50|}{300}\right)$$

wherein $\alpha=1$, $\beta=51-(\%\text{ Cu})$ (in the case where Cu=20 to 50%), $\beta=-19+0.4$ (% Cu) (in the case where Cu=50 to 90%) and wherein when the calculation value % $X_o$ of the equation is less than 0.01, % X is considered to be 0.01.

If the value of this equation is negative, the lower limit value of the content is set to be zero. As a result of the experiment by the inventors, the above equation was obtained, in the case where at least one element selected from the group consisting of Al, Sc, Y, La, Si, Ti, Zr and Hf (hereinafter referred to $X_1$ element(s)), by determining quantitatively the relationship between the contents of chromium and molybdenum, which promote the division into two phases, and the lower limit value of the amount of $X_1$ element(s). Besides, if $X_1$ element(s) is added excessively, it will be dissolved into the phase rich in copper, thereby deteriorating the electric conductivity. Consequently, the amount of $X_1$ element(s) must not exceed 10%.

On the other hand, since boron (B) and carbon (C) take substantially the same effects as the above-described group of $X_1$ element(s), at least one of those elements (hereinafter referred to $X_2$ element(s)) is added, the lower limit value of which is a value obtained from the above equation with $\alpha=0.01$. However, if $X_2$ element(s) is added excessively, coarse precipitates (for example, $Fe_2B$, $Fe_3C$) are generated, thus embrittling the structure. Therefore, the content is made not to exceed 1% when only boron is added or when both boron and carbon are added at the same time, and not to exceed 3% when only carbon is added. Either the $X_1$ element group or the $X_2$ element group may be added, and alternatively, both the groups may be added together.

Other characteristics of the present invention will be obvious from the description below with reference to tables and the attached drawings.

Figure 1:
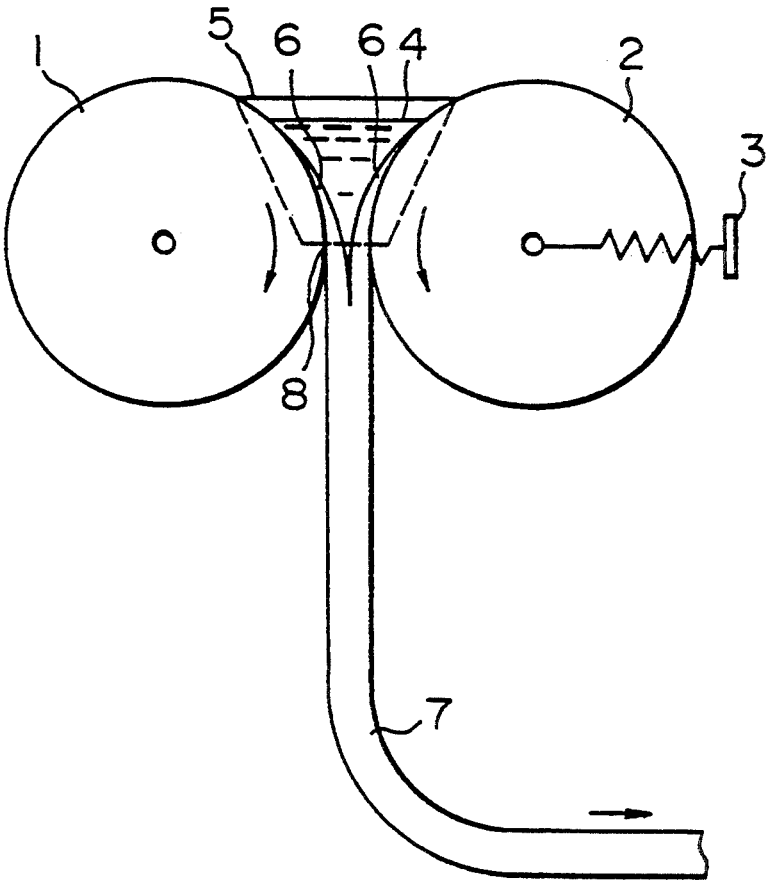
FIG. 1 is a schematic view of a twin-roll continuous casting apparatus which brings the present invention into practice.

In the present invention, Fe—Cu alloy sheets containing the above-described elements are manufactured by a thin plate continuous casting method. Especially, a thin casting with a thickness of 10 mm or less is produced. In this casting method, twin rolls are preferably employed. More specifically, as schematically shown in FIG. 1, cooling twin rolls 1 and 2 are provided with a pressing device 3 for castings. Molten metal from a molten metal pool 4 formed by the rolls 1, 2 and a side dam 5 is cooled by the twin rolls 1, 2 and turned into solidified shells 6, which are pressed by the pressing device 3 and drawn as a thin casting 7. The casting thus produced has an extremely fine and uniform structure because the casting, which can be formed as a thin plate of 5 mm or less, is cooled rapidly and contains the $X_1$ and/or $X_2$ element(s) mentioned above. Needless to say, however, the invention is not limited to the twin-roll casting method, and other methods (for example, a single-roll method, a belt casting method, and a caterpillar type casting method) may be employed so long as a thin-plate casting having a thickness of 10 mm or less can be obtained. Preferably the sheet has a grain size not greater than 2 mm and has a columnar grain ratio not smaller than 50%.

The above-described thin casting can be cold-rolled without hot-rolling process as to obtain a final product with a desired thickness or an intermediate material. Providing that the alloy of the invention is hot-rolled, the alloy will become brittle when it is heated, for instance, to a temperature of 1000° C. or more, so that hot-rolling of the alloy may become difficult. In the present invention, therefore, the casting is intended to have a thickness of 10 mm or less in order to cold-roll it directly. Besides, in the twin-roll method, there can be obtained castings having a thickness of 5 mm or less, as described previously, and it is advantageous to cold-rolling operation. After the cold-rolling operation, they are subjected to annealing treatment and the like, or if necessary, they are plated or punched. Thus, they can be turned into desired products, for example, electromagnetic materials and sheet products such as lead frames, and various forms of wire and foil.

EXAMPLE 1

Various kinds of the $X_1$ and/or $X_2$ element(s) having different amounts were added to the basic alloy materials (Fe—Cu system alloys) 1 to 5 shown in Table 1. After a mixture of the $X_1$ and/or $X_2$ element(s) and one of the basic alloy materials in total amounts of 1 kg was melted in a magnesia crucible at 1510° C., the melt was brought into contact with a chill member of copper and thereby cooled down rapidly. Thus, a plurality of samples were obtained. Cross-sections of the rapidly cooled samples (4 mm thick) thus obtained were observed by use of an optical microscope, and a structure fineness of each sample was examined to investigate the structure uniformity.

Tables 2 to 6 show values of the structure fineness of every $X_1$ and/or $X_2$ element corresponding to content ratios defined by the following equation:

$$(\%X) = \alpha\left(\frac{(\%\ Cr) + 2(\%\ Mo) - 3}{3} - \beta\frac{|(\%\ Cu) - 50|}{300}\right)$$

It should be noted that the structure fineness in this case means a maximum grain size.

TABLE 1

| Basic Alloy Material | Basic Alloying Element Cu % | Cr % | Mo % | Fe % |
|---|---|---|---|---|
| 1 | 50 | 6 | — | Bal. |
| 2 | 50 | 3 | 0.3 | Bal. |
| 3 | 70 | 6 | — | Bal. |
| 4 | 20 | 9 | 0.05 | Bal. |

TABLE 1-continued

| Basic Alloy Material | Basic Alloying Element Cu % | Cr % | Mo % | Fe % |
|---|---|---|---|---|
| 5 | 90 | 9 | 0.05 | Bal. |

TABLE 2

| Content Ratio | Structure fineness (μm) 0.1 | 0.5 | 0.7 | 1 | 2 | 5 | 10 |
|---|---|---|---|---|---|---|---|
| $X_1$ Element | | | | | | | |
| Al | 1500 | 1400 | 480 | 70 | 50 | 40 | 30 |
| Sc | 1500 | 1420 | 520 | 80 | 60 | 40 | 30 |
| Y | 1600 | 1450 | 530 | 100 | 70 | 50 | 40 |
| La | 1450 | 1380 | 520 | 90 | 80 | 60 | 40 |
| Si | 1480 | 1410 | 510 | 100 | 70 | 50 | 40 |
| Ti | 1520 | 1390 | 480 | 80 | 60 | 40 | 30 |
| Zr | 1510 | 1420 | 520 | 90 | 80 | 50 | 40 |
| Hf | 1460 | 1390 | 500 | 90 | 70 | 50 | 40 |
| *Note 3 | 1480 | 1400 | 490 | 80 | 60 | 40 | 40 |
| $X_2$ Element | | | | | | | |
| B | 1520 | 1300 | 550 | 70 | 50 | 30 | 30 |
| C | 1480 | 1400 | 650 | 90 | 70 | 40 | 40 |
| *Note 4 | 1500 | 1380 | 530 | 70 | 50 | 40 | 30 |
| *Note 5 | 1470 | 1390 | 500 | 70 | 50 | 30 | 30 |

*Note 1: This table shows results of a test whose subjects were alloys which were obtained by adding X element(s) to the basic alloy material 1 (50% Cu—6% Cr—Fe).

*Note 2: The content ratio was defined by the following equation:

$$(\%\ X) = \alpha\left(\frac{(\%\ Cr) + 2(\%\ Mo) - 3}{3} - \beta\frac{|(\%\ Cu) - 50|}{300}\right)$$

when the X 1 element(s) was added, $\alpha = 1$, and when the $X_2$ element(s) was added, $\alpha = 0.01$ and $\beta = 1$.

*Note 3: This is the case where all the $X_1$ elements having equal amounts were added.

*Note 4: This is the case where all the $X_2$ elements having equal amounts were added.

*Note 5: This is the case where all the $X_1$ and $X_2$ elements having equal amounts were added.

TABLE 3

| Content Ratio | Structure fineness (μm) 0.1 | 0.5 | 0.7 | 1 | 2 | 5 | 10 |
|---|---|---|---|---|---|---|---|
| $X_1$ Element | | | | | | | |
| Al | 1500 | 1380 | 450 | 80 | 40 | 40 | 30 |
| Ti | 1500 | 1420 | 490 | 70 | 50 | 40 | 30 |
| $X_2$ Element | | | | | | | |
| B | 1470 | 1310 | 530 | 80 | 40 | 30 | 30 |
| C | 1550 | 1380 | 600 | 70 | 60 | 40 | 40 |

*Note 1: This table shows results of a test whose subjects were alloys which were obtained by adding X element(s) to the basic alloy material 2 (50% Cu—3% Cr—0.3% Mo—Fe).

*Note 2: The content ratio was defined by the following equation:

$$(\%\ X) = \alpha\left(\frac{(\%\ Cr) + 2(\%\ Mo) - 3}{3} - \beta\frac{|(\%\ Cu) - 50|}{300}\right)$$

when the $X_1$ element(s) was added, $\alpha = 1$, and when the $X_2$ element(s) were added, $\alpha = 0.01$ and $\beta = 1$.

TABLE 4

| Content Ratio | Structure fineness (μm) 0.1 | 0.5 | 0.7 | 1 | 2 | 5 | 10 |
|---|---|---|---|---|---|---|---|
| $X_1$ Element | | | | | | | |
| Al | 1340 | 1180 | 400 | 70 | 40 | 40 | 30 |
| Ti | 1390 | 1220 | 390 | 60 | 50 | 40 | 30 |
| $X_2$ Element | | | | | | | |
| B | 1370 | 1210 | 440 | 70 | 40 | 30 | 30 |

TABLE 4-continued

| Content Ratio | Structure fineness (μm) 0.1 | 0.5 | 0.7 | 1 | 2 | 5 | 10 |
|---|---|---|---|---|---|---|---|
| C | 1390 | 1290 | 510 | 60 | 60 | 40 | 40 |

*Note 1: This table shows results of a test whose subjects were alloys which were obtained by adding X element(s) to the basic alloy material 3 (70% Cu—3% Cr—Fe).
*Note 2: The content ratio was defined by the following equation:

$$(\%\ X) = \alpha\left(\frac{(\%\ Cr) + 2(\%\ Mo) - 3}{3}\right) - \beta\frac{|(\%\ Cu) - 50|}{300}$$

when the $X_1$ element(s) were added, $\alpha = 1$, and when the $X_2$ element(s) were added, $\alpha = 0.01$ and $\beta = 9$.

TABLE 5

| Content Ratio | Structure fineness (μm) 0.1 | 0.5 | 0.7 | 1 | 2 | 5 | 10 |
|---|---|---|---|---|---|---|---|
| $X_1$ Element | | | | | | | |
| Al | 1620 | 1550 | 490 | 70 | 50 | 40 | 40 |
| Sc | 1510 | 1520 | 510 | 100 | 70 | 30 | 40 |
| Y | 1630 | 1610 | 500 | 80 | 60 | 40 | 30 |
| La | 1600 | 1550 | 420 | 75 | 60 | 50 | 40 |
| Si | 1580 | 1530 | 390 | 80 | 50 | 40 | 30 |
| Ti | 1390 | 1410 | 350 | 70 | 50 | 40 | 30 |
| Zr | 1400 | 1510 | 400 | 90 | 70 | 50 | 40 |
| Hf | 1450 | 1490 | 520 | 70 | 70 | 30 | 40 |
| $X_2$ Element | | | | | | | |
| B | 1510 | 1470 | 530 | 80 | 70 | 40 | 30 |
| C | 1480 | 1450 | 430 | 90 | 80 | 50 | 40 |

*Note 1: This table shows results of a test whose subjects were alloys which were obtained by adding X element(s) to the basic alloy material 4 (20% Cu—9% Cr—0.05% Mo—Fe).
*Note 2: The content ratio was defined by the following equation:

$$(\%\ X) = \alpha\left(\frac{(\%\ Cr) + 2(\%\ Mo) - 3}{3} - \beta\frac{|(\%\ Cu) - 50|}{300}\right)$$

When the $X_1$ element(s) were added, $\alpha = 1$, and when the $X_2$ element(s) were added, $\alpha = 0.01$ and $\beta = 31$.

TABLE 6

| Content Ratio | Structure fineness (μm) 0.1 | 0.5 | 0.7 | 1 | 2 | 5 | 10 |
|---|---|---|---|---|---|---|---|
| $X_1$ Element | | | | | | | |
| Al | 1620 | 1600 | 500 | 80 | 50 | 40 | 30 |
| Sc | 1630 | 1650 | 610 | 90 | 50 | 30 | 30 |
| Y | 1550 | 1500 | 410 | 100 | 80 | 40 | 40 |
| La | 1620 | 1610 | 520 | 90 | 70 | 40 | 40 |
| Si | 1610 | 1520 | 390 | 100 | 60 | 50 | 30 |
| Ti | 1610 | 1530 | 410 | 70 | 80 | 40 | 40 |
| Zr | 1540 | 1540 | 420 | 80 | 70 | 40 | 30 |
| Hf | 1380 | 1410 | 380 | 70 | 50 | 30 | 40 |
| $X_2$ Element | | | | | | | |
| B | 1430 | 1380 | 370 | 90 | 70 | 50 | 30 |
| C | 1440 | 1410 | 430 | 80 | 70 | 40 | 30 |

*Note 1: This table shows results of a test whose subjects were alloys which were obtained by adding X element(s) to the basic alloy material 5 (90% Cu—9% Cr—0.05% Mo—Fe).
*Note 2: The content ratio was defined by the following equation:

$$(\%\ X) = \alpha\left(\frac{(\%\ Cr) + 2(\%\ Mo) - 3}{3} - \beta\frac{|(\%\ Cu) - 50|}{300}\right)$$

When the $X_1$ element(s) were added, $\alpha = 1$, and when the $X_2$ element(s) were added, $\alpha = 0.01$ and $\beta = 17$.

Concerning any of the above-described basic alloy materials (samples), when each of the $X_1$ and $X_2$ elements of amounts corresponding to the content ratio of 1 were added, the structure became drastically finer and had no coarse structure of the two phases (the phase rich in iron and the phase rich in copper).

EXAMPLE 2

Referring to Table 7, 50% Cu-6% Cr—Fe alloys to which each of Al and Ti was added at six levels in a range of 0.1 to 5% were melted, and castings were manufactured from them by a twin-roll method which will be shown in FIG. 1. Rolls made of a copper alloy having a diameter of 30 mm and a width of 10 mm were used as cooling twin rolls 1, 2 in a continuous casting apparatus according to this twin-roll method. Casting operation was conducted under such conditions as a casting temperature of 1510° C. and a roll rotating speed of 20 rpm, and castings having a thickness of 2.2 mm were obtained. Cross-sections of the castings were observed by use of an optical microscope, and structure fineness of each casting was measured. Results of the measurement are shown in FIGS. 2*a* and 2*b* (reference symbol □ indicates a sample containing aluminum and reference symbol ▨ indicates a sample containing titanium).

Figure 2A:
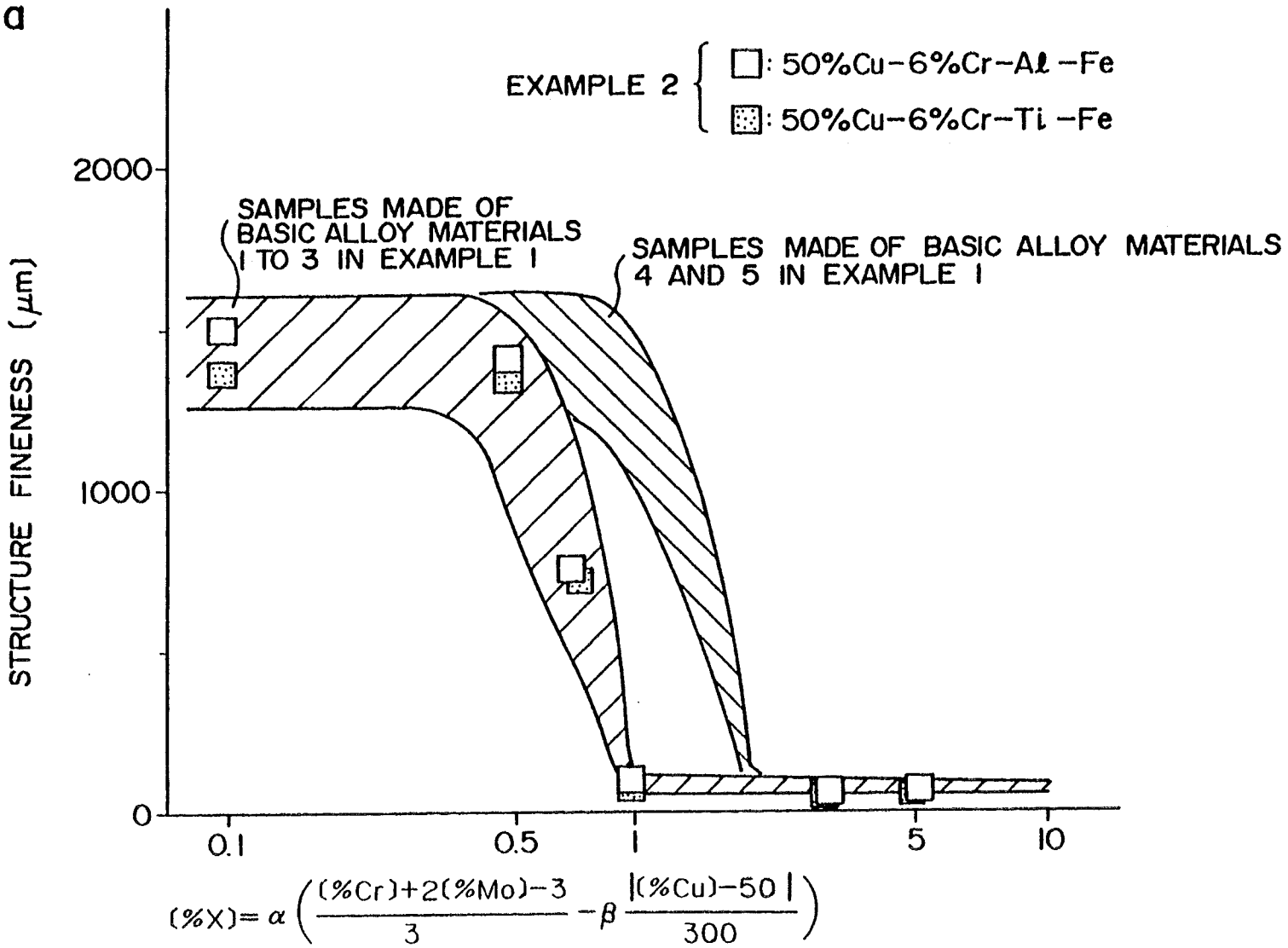
FIGS. 2*a* and 2*b* are graphs exhibiting relationships between amounts of additive components of the invention and the structure fineness.
Figure 2B:
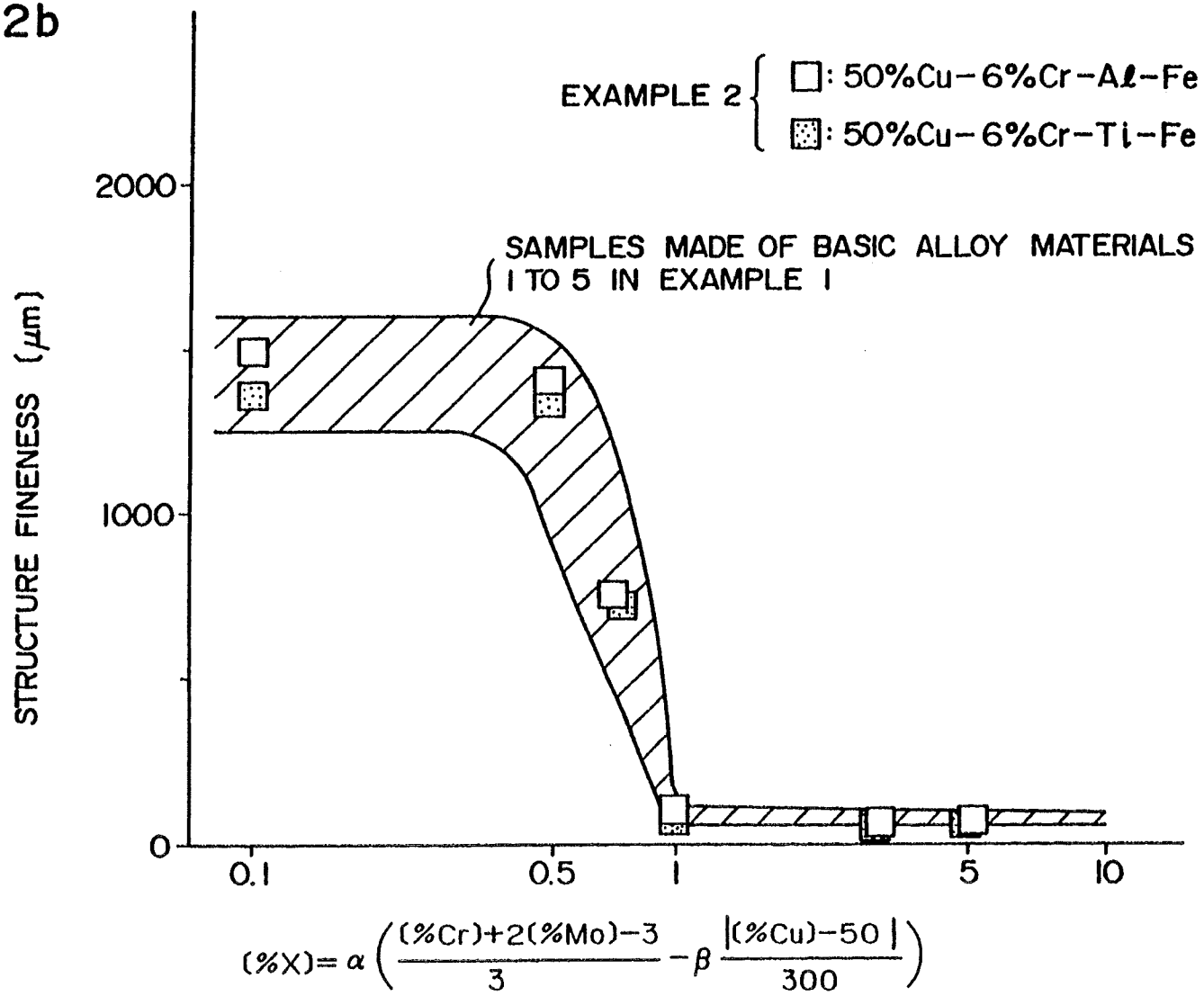

As clearly understood from FIGS. 2*a* and 2*b*, when the $X_1$ element(s) having amounts corresponding to the content ratio of less than 1 were added, they had the coarse structure divided into the two phases, and when the $X_1$ element(s) having amounts corresponding to the content ratio of 1 or more were added, the structure became drastically finer.

Examination results of the $X_1$ component(s) of the example 1 (indicated by slant-line portions) are also shown in FIGS. 2*a* and 2*b*. It is obvious from FIG. 2*a* that the basic alloy materials 1 to 3 of the example 1 exhibited substantially the same tendency as the example 2. As for the basic alloy materials 4 and 5 of the example 1, however, shifts in a direction of the axis of abscissas were observed, and consequently, a correction factor $\beta$ was introduced into the denominator of the equation defining the content ratio which is the index of the abscissas, so that the examination results would be uniform, as shown in FIG. 2*b*.

Table 7 shows results of evaluations in working characteristics (examinations of cracks in cold-rolled sheets) and physical properties for lead frame materials (critical numbers of cyclic bending in rupture tests and the corrosion resistance property) of the alloys thus obtained. More specifically, the above-mentioned castings designated by sample numbers 1 to 12 which had a thickness of 2.2 mm were first subjected to softening annealing treatment at a temperature of 800° C. for one hour. After that, they were immersed, at a speed of 1 m/min., in a tank of 1.5 m which contains 10-volume % nitric acid solution heated at a temperature of 50° C. so as to subject the iron phase to selective etching treatment. After that, the primary cold-rolling of these samples was performed at a reduction of 85%, and the examinations of cracking in cold-rolled sheets were conducted. Next, the samples which had undergone the crack examinatins were annealed at a temperature of 550° C. for three hours. In the course of the succeeding cooling process, they were aged at a temperature of 480° C. for three hours. After that, they were cooled down to a temperature of 100° C. at a rate of 50° C./hour, and the secondary cold-rolling of them was performed at a reduction of 8% to thereby obtain sheets having a thickness of 0.3 mm as the final products.

Bending tests of the product sheets thus obtained were conducted in the following manner so as to determine the critical numbers of cyclic bending operations in rupture tests. More specifically, the center of each product sheet having a width of 10 mm and a length of 50 mm was clamped by a vise and repeatedly bent at an angle of 90° along a circular arc having a radius of 0.25 mm. The number of bending operations until the product sheet was ruptured was counted and recorded as the critical number of cyclic bending operations in the rupture test.

As to the corrosion resistance property, the samples whose red rust generation rate exceeded a criterion of Fe-42Ni level as a result of a salt spray test for 48 hours were judged to be approved.

TABLE 7

| Sample Number | Additive Element | Content Ratio | Examination of Crack in Cold-Rolled Sheet | Critical Number of Bending Operations and Judgement in Rupture Test | Corrosion Resistance |
|---|---|---|---|---|---|
| 1 | Al | 0.1 | X | 4 X | X |
| 2 | Al | 0.5 | X | 5 X | X |
| 3 | Al | 0.7 | X | 5 X | X |
| 4 | Al | 1 | ○ | 11 ○ | ○ |
| 5 | Al | 3 | ○ | 12 ○ | ○ |
| 6 | Al | 5 | ○ | 13 ○ | ○ |
| 7 | Ti | 0.1 | X | 4 X | X |
| 8 | Ti | 0.5 | X | 5 X | X |
| 9 | Ti | 0.7 | X | 5 X | X |
| 10 | Ti | 1 | ○ | 12 ○ | ○ |
| 11 | Ti | 3 | ○ | 14 ○ | ○ |
| 12 | Ti | 5 | ○ | 14 ○ | ○ |

*Note 1: 50%Cu—6%Cr—Fe was used as a basic alloy material.
*Note 2: Results of examinations and judgements, and corrosion resistance inspections are indicated by reference symbol ○ when a sample was approved X when a sample was rejected.
*Note 3: In this composition, the content ratio is equal to the content [% X].

It can be understood from Table 7 that the materials containing aluminum or titanium whose content was 1% or more exhibited favorable results in the examination of cracks in cold-rolled sheets, the critical number of bending operations in rupture test and the corrosion resistance (the samples of the invention), and that the samples 1 to 3 and 7 to 9 having less than 1% aluminum or titanium were all rejected.

INDUSTRIAL APPLICABILITY

According to the present invention, there can be obtained alloy materials which have excellent cold working characteristics and excellent physical properties, and which have an extremely fine structure without being divided into the two phases when they are melted, so that they will be suitably used as materials of electronic and magnetic parts or the like.

What is claimed is:

1. An Fe—Cu alloy consisting essentially of, by weight, 20 to 90% Cu, 1 to 10% Cr, 0.01 to 10% Mo, and one or more of alloying elements selected from the group consisting of Al, Sc, Y, La, and Hf whose amount or total amounts expressed as % X are not less than % $X_o$, and not more than 10%, the balance being essentially Fe:

wherein $$\% X_o = \left( \frac{(\% \text{ Cr}) + 2(\% \text{ Mo}) - 3}{3} - \beta \frac{|(\% \text{ Cu}) - 50|}{300} \right) \quad 1.$$

wherein $\beta = 51 - (\%\ \text{Cu})$ (in the case where Cu=20 to 50)

$\beta = -19 + 0.4\ (\%\ \text{Cu})$ (in the case where Cu=50 to 90%), and further provided that when the calculation value % $X_o$ of the equation 1 is less than 0.01, % X is considered to be about 0.01.

2. An Fe—Cu alloy sheet having an alloy structure of high uniformity which consists essentially of, by weight, 20 to 90% Cu, 1 to 10% Cr, 0.01 to 10% Mo, and one or more of alloying elements selected from the group consisting of Al, Sc, Y, La and Hf whose amount or total amounts expressed as % X are not less than a calculation value % $X_o$ of the following equation 1, and not more than 10%, the balance being essentially Fe:

$$\% X_o = \left( \frac{(\% \text{ Cr}) + 2(\% \text{ Mo}) - 3}{3} - \beta \frac{|(\% \text{ Cu}) - 50|}{300} \right) \quad 1.$$

wherein $\beta = 51 - (\%\ \text{Cu})$ (in the case where Cu=20 to 50), $\beta = -19 + 0.4\ (\%\ \text{Cu})$ (in the case where Cu=50 to 90%), and further provided that when the calculation value % $X_o$ of the equation 1 is less than 0.01, % X is about 0.01.

3. An Fe—Cu alloy sheet manufactured by a thin plate continuous casting method, said alloy sheet having a thickness not greater than 10 mm and alloy structure of high uniformity which consists essentially of, by weight, 20 to 90% Cu, 1 to 10% Cu, 0.01 to 10% Mo, one or more of alloying elements selected from the group consisting of Al, Sc, Y, La, and Hf whose amount or total amounts expressed as % X are not less than a calculation value % $X_o$ of the following equation 1 and not more than 10%, and boron and/or carbon whose amount or total amounts expressed as % X have a lower limit value % $X_o$ of the following equation 2, and have an upper limit value which is 1% when only boron is present and when both boron and carbon are present and which is 3% when only carbon is present, the balance being essentially Fe, the Equation 1:

$$\% X_o = \left( \frac{(\% \text{ Cr}) + 2(\% \text{ Mo}) - 3}{3} - \beta \frac{|(\% \text{ Cu}) - 50|}{300} \right)$$

and wherein when the calculation value % $X_o$ of the equation 1 is less than 0.01, % X is about 0.01, $\beta = 51 - (\%\ \text{Cu})$ (in the case where Cu=20 to 50), $\beta = -19 + 0.4\ (\%\ \text{Cu})$ (in the case where Cu=50 to 90%); and the Equation 2:

$$\% X_o = 0.01 \left( \frac{(\% \text{ Cr}) + 2(\% \text{ Mo}) - 3}{3} - \beta \frac{|(\% \text{ Cu}) - 50|}{300} \right)$$

and wherein when the calculation value % $X_o$ of the equation 1 is less than 0.0001 then % X is about 0.0001, $\beta = 51 - (\%\ \text{Cu})$ (in the case where Cu=20 to 50%), $\beta = -19 + 0.4\ (\%\ \text{Cu})$ (in the case where Cu+50 to 90%).

* * * * *